US005219446A

United States Patent [19]

Klepac

[11] Patent Number: 5,219,446

[45] Date of Patent: Jun. 15, 1993

[54] PORTABLE TOOL BOX

[76] Inventor: Daniel T. Klepac, 5411 Rancho Rd., Needville, Tex. 77461

[21] Appl. No.: 954,286

[22] Filed: Sep. 30, 1992

[51] Int. Cl.[5] ..... F21V 33/00

[52] U.S. Cl. ..... 362/154

[58] Field of Search ..... 362/154, 253

[56] References Cited

U.S. PATENT DOCUMENTS 2,819,938 1/1958 Zerver .
3,177,358 4/1965 Suttie .
3,231,730 1/1966 Wagner .
3,294,968 12/1966 Cloyd .
4,458,304 7/1984 Imsdahl .
4,458,963 7/1984 Keddie .
4,667,822 5/1987 Coopmans .
4,861,050 8/1989 Bergeron .
5,143,440 9/1992 Trampota ..... 362/154

*Primary Examiner*—Carroll B. Dority
*Attorney, Agent, or Firm*—Pravel, Hewitt, Kimball & Krieger

[57] ABSTRACT

A portable tool box including a swivel light fixture as well as an extension cord and several outlets for use of various power tools. The light source is fixedly attached to the portable tool box and cannot be extended in any manner, but rather can only be swiveled to provide light in the particular direction desired. The portable tool box also includes tool carrying members on either sides of the tool box having holes for receiving various types of tools such as screwdrivers and the like.

4 Claims, 1 Drawing Sheet

FIG. 1
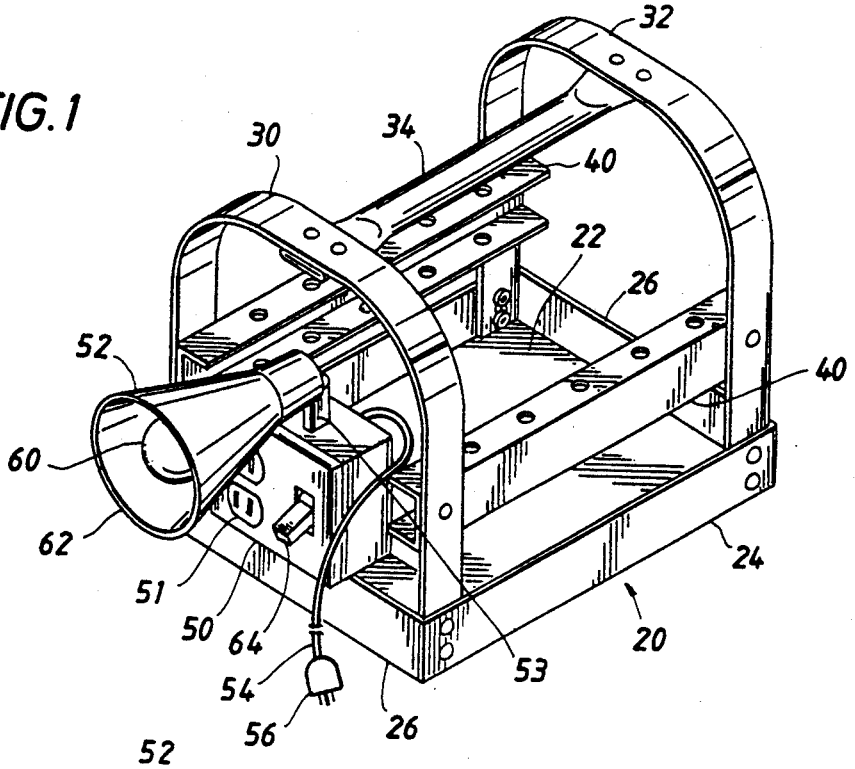
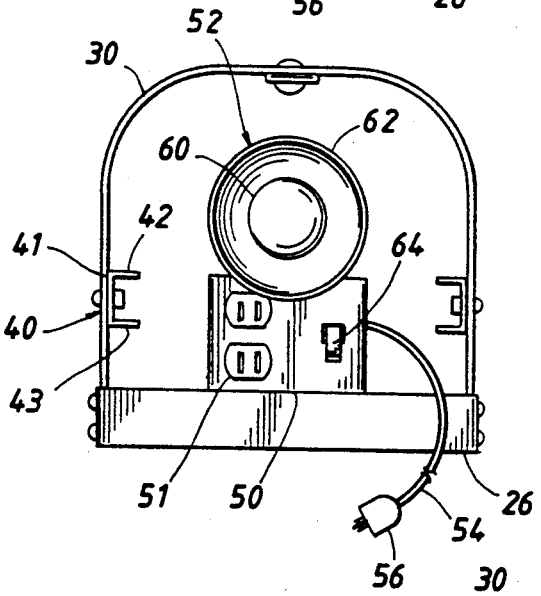
FIG. 3
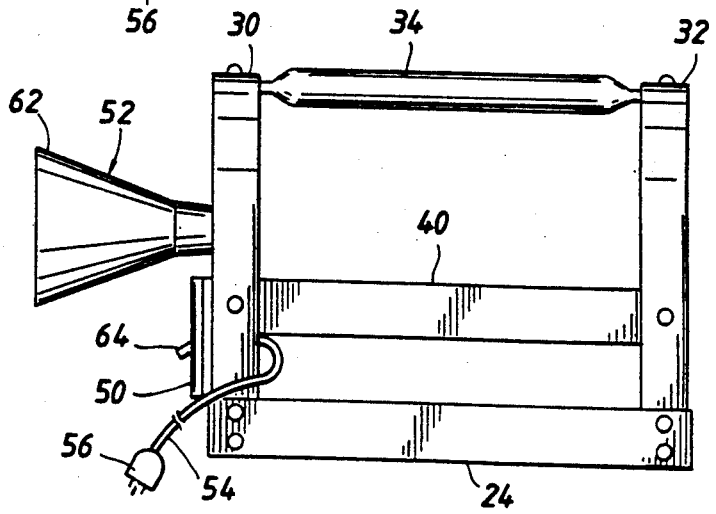
FIG. 2

PORTABLE TOOL BOX

FIELD OF THE INVENTION

The present invention relates to a portable tool box which includes a utility light, an electrical receptacle, and an electric cord, as well as a C-channel member for holding screwdrivers and other tools.

DESCRIPTION OF THE PRIOR ART

Various kinds of portable tool boxes have been developed over the years. For example U.S. Pat. No. 3,231,730 to Wagner discloses a combination tool tray and extension light. The extension light is mounted on an adjustable light support to enable the light source to be positioned as necessary to illuminate the particular work area involved. The tool box disclosed in Wagner also included an electric cord and an electric outlet for the use of electric power tools.

One disadvantage of the Wagner device is that the device does not include adequate storage space for tools such as screwdrivers, etc. The Wagner device only includes one tool tray bed into which all power tools and other tools must be stored, thus making it difficult for a user to find smaller tools such as screwdrivers, etc. Another disadvantage of the Wagner device is that the extendable nature of the light often results in the user inadvertently hitting the extension light with a tool, thus breaking the bulb and causing inconvenience to the user of having to leave his now dark work area and find a replacement bulb for the light.

In addition, the extendable light also serves as the carrying handle in the Wagner device. The extendable light is fixedly attached at one end while the other end is attached to the other end of the tool box by means of a pin. Thus, when the tool box contains a number of heavy items, such as several power tools, a large amount of strain is placed on the extendable light and the pin, eventually resulting in breakage of the pin or the extendable light. Also, the extendable light must be reattached to the tool box by means of the pin each time the user desires to move the tool box. This results in inconvenience to the user as the light must be reattached and repositioned each time the user moves the tool box.

Therefore, the combination tool tray and extension light disclosed in Wagner includes several disadvantages, including a lack of area or space for various types of tools as well as a bulky extendable light which is prone to being broken due to its extendable nature. In addition, the extendable light is ill-equipped to serve as a handle.

U.S. Pat. Nos. 4,458,963 to Keddie and 4,667,822 to Coopmans disclose tool caddies for carrying tools, but do not disclose work lights.

U.S. Pat. Nos. 4,861,050 to Bergeron, 2,819,938 to Zerver, and 3,294,968 to Cloyd, each disclose various work light combinations with tool carrying devices.

In addition, U.S. Pat. No. 3,177,358 to Suttie discloses a work light fixture.

Further, design patent application Ser. No. 950,032 was filed on Sep. 22, 1992 claiming the ornamental features of the present invention.

SUMMARY OF THE INVENTION

The present invention comprises a portable tool box including a swivel light fixture as well as an extension cord and multiple outlets for use of various power tools.

The light fixture is fixedly attached to the portable tool box and cannot be extended in any manner, but rather can only be swiveled to provide light in the particular direction desired. The portable tool box also includes C-channel tool carrying members on either side of the tool box having holes for receiving various types of tools such as screwdrivers and the like.

BRIEF DESCRIPTION OF THE DRAWINGS

A better understanding of the present invention can be obtained when the following detailed description of the preferred embodiment is considered in conjunction with the following drawings, in which:

FIG. 1 is a perspective view of the portable tool box according to the present invention;

FIG. 2 is a side view of the portable tool box of FIG. 1; and

FIG. 3 is a left side view of FIG. 2.

DETAILED DESCRIPTION OF THE PREFERRED EMBODIMENT

Referring now to FIG. 1, the portable tool box of the present invention includes a tool tray 20, preferably formed of metal. The tool tray 20 includes a bottom 22, preferably rectangular in shape, corresponding side walls 24, and opposing end walls 26. The side walls 24 and end walls 26 are preferably of sufficient height to contain various types of tools within the tool tray 20 but not too high so as to allow easy access to tools stored in the tool tray.

The tool tray 20 is preferably used to carry various types of tools including hammers, wrenches, power tools, etc. that a user may desire to carry with him to his work area.

Support members 30 and 32 each include two ends which connect at corresponding respective corners where an end wall 26 meets respective side walls 24. Each support member 30 and 32 is shaped approximately in the form of a half oval, having more of a rectangular shape as shown. The support members 30 and 32 are preferably connected at opposite ends of the tool tray 20 as shown by fastening means such as screws, bolts, or rivets.

A carrying handle 34 is connected at corresponding points at the apex of each of the support members 30 and 32 as shown. The carrying handle 34 is preferably connected by fastening means such as screws, bolts, or rivets. The carrying handle 34 allows the portable tool box to be easily transported from various work locations as desired.

A tool carrying member 40 has ends connected at corresponding points on each of the support members 30 and 32. In the preferred embodiment, two tool carrying members 40 are included. The tool carrying members 40 are connected at points along each of the support members 30 and 32, such that each tool carrying member 40 is approximately parallel to a respective side wall 24 comprising the tool tray 20 and is approximately perpendicular to the portion of the support members 30 and 32 connected to the tool tray 20.

As shown in FIGS. 1 and 3, the tool carrying members 40 are preferably C-channel members. Referring now to FIG. 3, the tool carrying members 40 each include a first member 41 that is fixedly attached to the corresponding points on the support members 30 and 32 and first and second flanges 42 and 43, respectively, connected to opposing sides of the first member 41 such that the first and second flanges 42 and 43 are each perpendicular to the first member 41 and parallel to each other. The first and second flanges 42 and 43 each include holes approximately adjacent thereto to allow tools such as screwdrivers to be inserted into the top hole of the first flange 42 and then down through the respective hole in the second flange 43 to support the screwdriver. In this manner, a plurality of different types of screwdrivers, as well as other tools, may be carried in the portable tool box while reserving the space in the tool tray 20 for larger tools such as power tools, etc.

At one end wall 26 of the portable tool box is a double plug female type receptacle 50. The double plug receptacle 50 includes two electrical sockets as shown. A light source 52 is connected to the top portion of the receptacle 50 by means of a swivel 53. The light source 52 includes a light bulb 60 and a light cover 62 as shown. The light source 52 is not extendable, but rather is a swivel-type light source that is fixedly attached by means of the swivel 53 to the top of the receptacle 50 and may be swiveled in different positions to illuminate a desired area. In this manner, more protection is provided for the light bulb 60, thus protecting the light source 52 and allowing longer periods of uninterrupted work. The tool carrying members 40 also provide a degree of protection for the light source 52.

A conventional electric cord 54 extends from the receptacle 50. The electric cord 54 includes a conventional electric plug 56 at one end. The plug 56 is preferably connected to a separate extension cord (not shown) in order to provide electricity to the receptacle 50. In an alternate embodiment of the invention, the receptacle 50 also houses a rechargeable battery which may be used to provide power to the receptacle 50 and the light 52 without using the extension cord 54.

The receptacle 50 includes a switch 64 which operates the light 52. Alternatively, the switch may also be used to provide power to the outlets 51, as desired.

FIGS. 2 and 3 illustrate alternative views of the portable tool box of the present invention.

The portable tool box of the present invention is ideal for use in areas where other light sources and electrical outlet sources are not readily available. One particular area where the portable tool box of the invention may be commonly used is in attics or basements where light sources or electrical outlets are not readily available. The portable tool box of the invention obviates the requirement of a user having to bring a separate light source to various work locations where a light source is not readily available. In addition, the sockets or outlets 51 provided in the receptacle 50 provide a convenient way for the use of power tools in areas where no electrical receptacles are available. Further, the portable tool box of the present invention includes a handle that is fixedly attached to support members as well as tool carrying members which provide a sturdy design and further protect the light source from breakage.

Having described the invention above, various modifications of the techniques, procedures, material and equipment will be apparent to those in the art. It is intended that all such variations within the scope and spirit of the appended claims be embraced thereby.

I claim:

1. A portable tool box comprising:

a tool tray including a bottom portion having first and second opposite ends and third and fourth opposite ends, side walls fixedly-attached to said first and second opposite ends of said bottom portion, and approximately perpendicular to said bottom portion, and end walls fixedly attached to said third and fourth opposite ends of said bottom portion and having ends connected to ends of said side walls;

first and second support members, each said support member including two ends connected to opposite ends of said tool tray;

a carrying handle having ends fixedly attached to said first and second support members;

a tool carrying member having ends connected to said support members, said tool carrying member for storing tools such as screwdrivers and the like;

an electrical receptacle fixedly attached to said tool tray including at least one outlet;

a non-extendable light source attached to said receptacle; and an electric cord connected to said receptacle for providing electricity to said light source and said outlet.

2. The portable tool box of claim 1, wherein said tool carrying member includes:

a first member having opposite ends fixedly attached to said support members and including top and bottom sides;

a first flange having one side connected to said top side of said first member being approximately perpendicular to said first member; and a second flange having one side connected to said bottom side of said first member being approximately perpendicular to said first member and approximately parallel to said first flange, said first and second flanges each including a plurality of adjacently spaced holes for receiving tools.

3. The portable tool box of claim 1, further comprising:

swivel means attached to said receptacle;

wherein said non-extendable light source is fixedly attached to said swivel means such that said light source can be swiveled relative to said receptacle.

4. The portable tool box of claim 1, wherein said receptacle further includes a re-chargeable battery which provides power to said light source and said outlets.

* * * * *